US007217918B1

(12) United States Patent
Funsten et al.

(10) Patent No.: US 7,217,918 B1
(45) Date of Patent: May 15, 2007

(54) APPARATUS AND METHOD FOR HYDROGEN AND OXYGEN MASS SPECTROMETRY OF THE TERRESTRIAL MAGNETOSPHERE

(75) Inventors: Herbert O. Funsten, Los Alamos, NM (US); Eric E. Dors, Los Alamos, NM (US); Ronnie W. Harper, Los Alamos, NM (US); Daniel B. Reisenfeld, Stevensville, MT (US)

(73) Assignee: Los Alamos National Security, LLC, Los Alamos, NM (US)

( * ) Notice: Subject to any disclaimer, the term of this patent is extended or adjusted under 35 U.S.C. 154(b) by 0 days.

(21) Appl. No.: 11/354,354

(22) Filed: Feb. 14, 2006

(51) Int. Cl.
*H01J 49/40* (2006.01)

(52) U.S. Cl. ..... 250/283; 250/281; 250/282

(58) Field of Classification Search ..... 250/283, 250/281, 282
See application file for complete search history.

(56) References Cited

U.S. PATENT DOCUMENTS 4,489,237 A * 12/1984 Litherland et al. ..... 250/287
5,189,302 A * 2/1993 Roberts et al. ..... 250/288
5,545,894 A * 8/1996 Funsten et al. ..... 250/281

OTHER PUBLICATIONS

W. Lennartsson et al., "A Comparison of the 0.1-17 keV/e Ion Composition in the Near Equatorial Magnetosphere Between Quiet and Disturbed Conditions," J. Geophys. Res, vol. 87, No. A8, pp. 6109-6120, Aug. 1982.

H.O. Funsten et al., "Absolute Detection Efficiency of Space-Based Ion Mass Spectrometers and Neutral Atom Imagers," Review of Scientific Instruments, vol. 76, 2005.

J.F. Ziegler et al., "The Stopping and Range of Ions in Solids," Pergamon, New York, vol. 1, pp. 141-164, 1985.

* cited by examiner

*Primary Examiner*—Kiet T. Nguyen
(74) *Attorney, Agent, or Firm*—Mark N. Fitzgerald

(57) ABSTRACT

A detector element for mass spectrometry of a flux of heavy and light ions, that includes: a first detector to detect light ions that transit through a foil operatively placed in front of the first detector, and a second detector that detects the flux of heavy and light ions.

18 Claims, 7 Drawing Sheets

APPARATUS AND METHOD FOR HYDROGEN AND OXYGEN MASS SPECTROMETRY OF THE TERRESTRIAL MAGNETOSPHERE

STATEMENT REGARDING FEDERAL RIGHTS

This invention was made with government support under Contract No. W-7405-ENG-36 awarded by the U.S. Department of Energy. The government has certain rights in the invention.

FIELD OF THE INVENTION

The present invention relates generally to spectrometry, and, more particularly, to a spectrometer that uses an electrostatic energy-per-charge analyzer to select an energy passband of incident ions.

BACKGROUND OF THE INVENTION

Driven by disturbances in the solar wind, geomagnetic storms and substorms energize the near-Earth space environment, causing numerous deleterious effects such as damage to spacecraft materials, communications problems, and spacecraft charging. While hydrogen ions ($H^+$) are ubiquitous in the Earth's magnetosphere, oxygen ions ($O^+$) at keV energies form a substantial but variable component of the Earth's plasma environment. Geostationary Operational Environmental Satellites (GOES) measurements indicate that in the geosynchronous region the concentration of 1–15 keV $O^+$ is highly dependent on geomagnetic activity, local time, and distance from Earth. Additionally, at magnetic shells L~7–8 (which are defined as the extension of the Earth's dipole magnetic field lines from their radial distance L (in units of earth radii) from the Earth at the Earth's magnetic equator), the most abundant ion during quiet time and moderately disturbed conditions is $H^+$, while during strongly disturbed conditions the $O^+$ density and energy density can be comparable to that of $H^+$ on the dayside magnetosphere.

A summary of results from measurements of the space environment for ions averaged over 0.1–17 keV/e and pitch angles in the range 45°–135° at L~5 is [W. Lennartsson and R. D. Sharp, "A comparison of 0.1–17 keV/e ion composition in the near equatorial magnetosphere between quiet and disturbed conditions," J. Geophys. Res. 87 (1982) 6109]:

(1) $O^+$ is typically comparable to $H^+$ in density and is often the dominant species, particularly during quiet times.

(2) The density ratio $n(O^+)/n(H^+)$ peaks at the lowest magnetic L-shell values and are, on average, higher during quiet times than during the early main phase of major geomagnetic storms.

(3) $H^+$ and $O^+$ have comparable mean energies (usually 2–7 keV) within the measured energy window, and the energies are highest during geomagnetically disturbed times.

Not only is $O^+$ a major, but variable, constituent of the terrestrial magnetosphere, $O^+$ can also damage spacecraft materials through a different process than $H^+$. For ion energies less than approximately 50 keV, $H^+$ loses most of its energy (e.g., 94% for 10 keV $H^+$ incident on silicon [H. O. Funsten, S. M. Ritzau, R. W. Harper, J. E. Borovsky, and R. E. Johnson, Energy Loss by keV Ions in Silicon, *Phys. Rev. Lett.,* 92 (2004) 212301–212304.] to excitations and ionizations of electrons in the target material. While this energy loss process cannot damage conductors or semiconductors, in dielectric material this can result in charging (and therefore damaging electrostatic discharges), chemical modification of the material, and degradation of electronics and electrical components. Over the same energy range, $O^+$ loses most of its energy (e.g., 66% for 10 keV $O^+$ incident on silicon [H. O. Funsten, S. M. Ritzau, R. W. Harper, J. E. Borovsky, and R. E. Johnson, Energy Loss by keV Ions in Silicon, *Phys. Rev. Lett.,* 92 (2004) 212301–212304] to Coulombic interactions with nuclei in the target, causing atomic displacement and rearrangement along the ion track in both dielectric and conductive material. This can result in chemical modification, physical modification of the material structure, sputtering, and degradation of electronics and electrical components. Due to the large difference in the types of damage induced by $H^+$ and $O^+$, and substantial variation in abundances of these species, their measurement is critical for understanding the plasma environment and effects on spacecraft materials.

Mass spectrometers have been flown in the Earth's magnetosphere to study the composition of the terrestrial magnetosphere in order to better understand its structure, dynamics, and coupling to the ionosphere and solar wind. These instruments typically utilize a foil-based time-of-flight (TOF) technique in which an ion of known energy transits a thin foil, where it emits secondary electrons that are detected and used to start a timer, and then continues through a drift section and is detected, stopping the timer. The time-of-flight of an ion across a known distance of travel allows the ion's mass to be determined if its energy is known. These TOF instruments, which have a field-free drift section, have a mass resolution $m/\Delta m$ typically in the range of 7–10. However, these instruments require fast timing circuits, long drift lengths, and, often, multiple detectors, resulting in large mass, volume, and power requirements.

The present invention addresses the negative aspects of prior art instruments by exhibiting simplicity, lower mass, lower power, lower volume, and lower cost, which results from the absence of a traditional drift region that uses considerable volume and the fast timing circuitry of the TOF system.

Various objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims

SUMMARY OF THE INVENTION

In accordance with the purposes of the present invention, as embodied and broadly described herein, the present invention, a detector element for mass spectrometry of a flux of heavy and light ions, includes: a first detector to detect light ions that transit through a foil operatively placed in front of the first detector, and a second detector that detects the flux of heavy and light ions.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION

The present invention comprises a low resource thin-foil technique to distinguish a light ion, such as hydrogen ions ($H^+$), from heavy ions, such as oxygen ions ($O^+$), in magnetospheric plasmas, where light and heavy ions are defined hereinafter that, over a specified energy range, most or all light ions can transit a foil of a specified composition and thickness, whereas most or all heavy ions cannot transit the same foil. Thus, measurements of H+ from O+ flux distributions enables monitoring and assessment of the plasma environment of a spacecraft and the activity level of the magnetosphere.

Advantages of the invention relative to current space-based mass spectrometer techniques include simplicity, lower mass, lower power, lower volume, and lower cost. This primarily results from the absence of a traditional drift region, which uses considerable volume and the fast timing circuitry of the time-of-flight (TOF) system.

Measurement of $O^+$ in the Earth's magnetosphere is important for understanding the initiation and evolution of geomagnetic activity. Furthermore, since ambient $O^+$ and $H^+$ fluxes from the ubiquitous plasma in the Earth's magnetosphere damage exposed spacecraft materials through different processes, measurement of the $O^+$ and $H^+$ fluxes is important for understanding cumulative damage effects to these materials due to the ambient plasma environment.

Figure 1A:
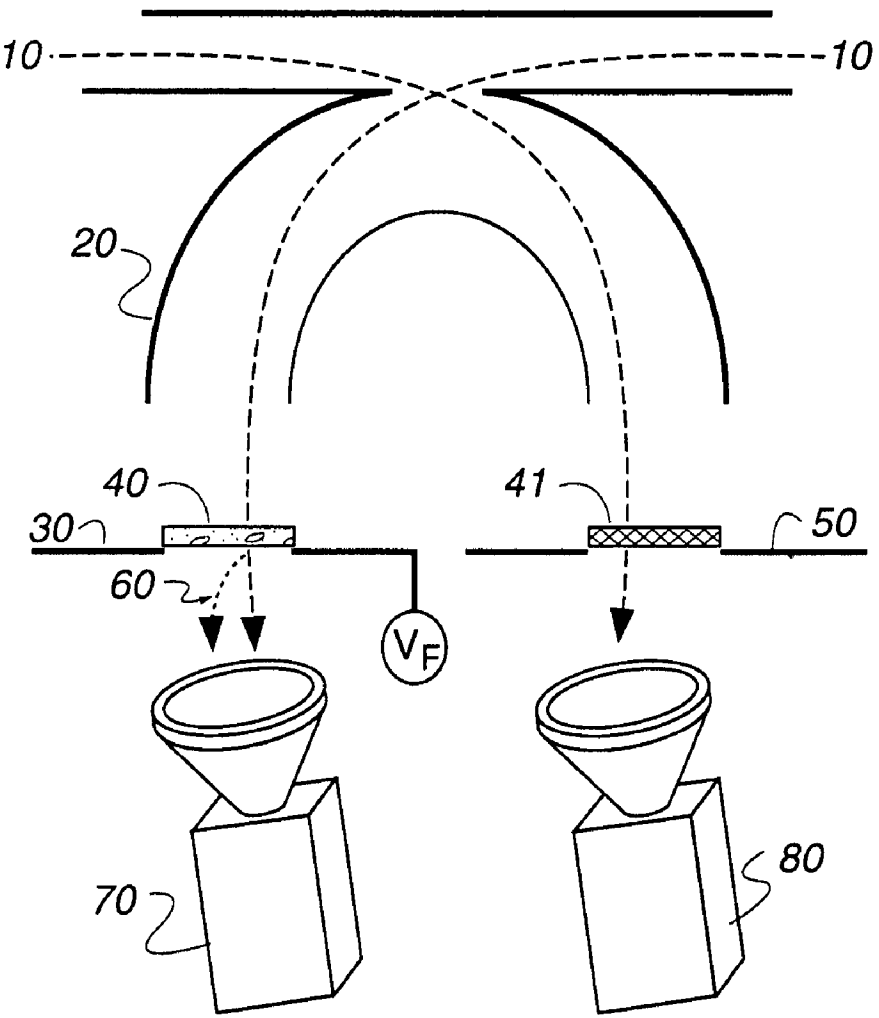
FIG. 1*a* shows a schematic of one embodiment of a detector element.

Referring now to FIG. 1*a* showing a detector element, electrostatic energy-per-charge analyzer (ESA) 20 is used to select an energy passband of incident ions 10. Ions 10 subsequently travel through either foil-less aperture 50 or aperture 30 covered by foil 40 of sufficient thickness so that most or all $H^+$ ions of the selected energy can transit foil 40, however, most or all $O^+$ ions of the selected energy are stopped in foil 40. Ions 10 that transit foil 40 are detected using first electron multiplier detector 70, such as a microchannel plate detector or channel electron multiplier. Ions that transit foil-less aperture 50 are detected using second electron multiplier detector 80 (also a microchannel plate detector or channel electron multiplier).

Comparison of the counts obtained for ions transiting foil-less aperture 50 and detected by second detector 80 and counts obtained for ions transiting aperture 30 with foil 40 and detected by first detector 70 allow measurement of the incident $H^+$ flux and the incident $O^+$ flux. In practice, the count rate of $H^+$ that transits foil 40 and is measured by first detector 70 and the count rate of $H^+$ and $O^+$ that transit foil-less aperture 50 and are measured by second detector 80 are functions of the detection probabilities of $H^+$ and $O^+$, the transmission probability of $H^+$ and $O^+$ through foil 40 at the selected energy, directional asymmetries in the incident plasma flux, and the transmission of a grid, if used, to support foil 40.

Figure 1B:
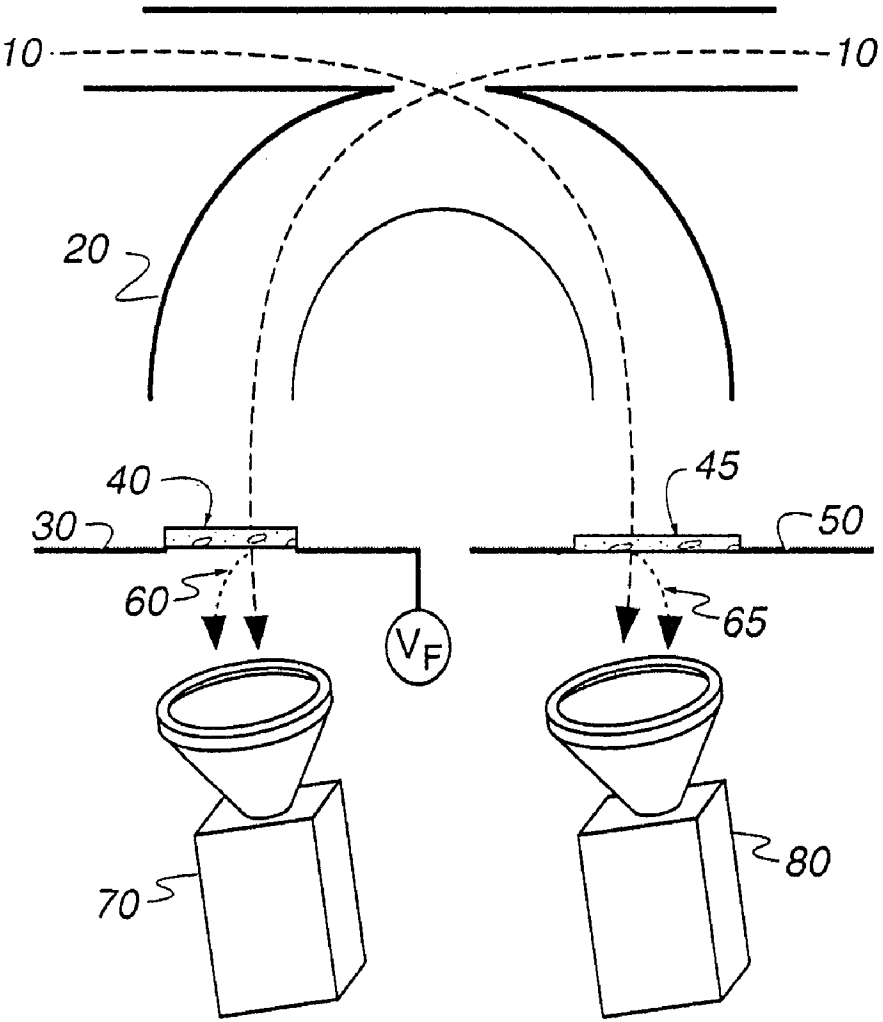
FIG. 1*b* shows a schematic of another embodiment of the invention where a thin foil is placed over the open aperture.

A similar embodiment is shown in FIG. 1*b*, the difference being the use of thin foil 45 covering aperture 50 where thin foil 45 is sufficiently thin so that most or all $H^+$ ions and most or all $O^+$ ions incident on thin foil 45 transit thin foil 45. The advantage of using thin foil 45 is that the detection efficiency of ions transiting thin foil 45 and detected by detector 80 is similar to the detection efficiency of ions transiting foil 40 and detected by detector 70. In both cases, an ion transiting the foil can be detected by detecting the ion itself, detecting secondary electrons generated by the ion at the back surface of the foil, or a combination of the two.

Referring to FIG. 1*b*, ions 10 transiting electrostatic energy-per-charge analyzer 20 subsequently travel through either aperture 50 covered by thin foil 45 or aperture 30 covered by foil 40 of sufficient thickness so that most or all $H^+$ ions of the selected energy can transit foil 40, however, most or all $O^+$ ions of the selected energy are stopped in foil 40. Ions 10 that transit foil 40 are detected using first electron multiplier detector 70, such as a microchannel plate detector or channel electron multiplier. Ions that transit thin foil 45 are detected using second electron multiplier detector 80 (also a microchannel plate detector or channel electron multiplier). Foil 40 and thin foil 45 may include a grid for structural support of the foil. The count rate of H+that transits foil 40 and is measured by first detector 70 and the count rate of $H^+$ and $O^+$ that transit thin foil 45 by second detector 80 are functions of the detection probabilities of $H^+$ and $O^+$, the transmission probability of $H^+$ and $O^+$ through foil 40 and thin foil 45 at the selected energy, directional asymmetries in the incident plasma flux, and the transmission of grids, if used, to support foil 40 and thin foil 45.

Calculation

The count rate $C_1$ resulting from ions that are incident on first detector 70 is $$C_1 = A\phi T_G \epsilon_1 T_F \tag{1}$$

where A is the aperture area, $\phi$ is the ion flux incident on foil 40, $T_G$ is the grid transmission if a grid is used (otherwise $T_G=1$), and $T_F$ is the probability of ion transmission through foil 40. The detection efficiency $\epsilon_1$ includes the detection efficiency of ions 10 that are transmitted through foil 40 and, assuming that foil 40 is biased negative with respect to the front of first detector 70, secondary electrons 60 generated by ions 10 at the back surface of foil 40.

The count rate $C_2$ resulting from ions 10 detected by second detector 80, which lies behind foil-less aperture 50, is $$C_2 = A\phi T_G \epsilon_2 \tag{2}$$

where $\epsilon_2$ is the detection efficiency of ions that are incident on second detector 80. The grid transmission ($T_G$), aperture area (A), and ion beam flux ($\phi$) for each ion species are assumed to be the same as in Equation 1. Referring again to FIG. 1*a*, conductive grid 41 may be attached spanning foil-less aperture 50 to generate a uniform, planar electric field in front of second detector 80 that helps to ensure consistent detector performance. Conductive grid 41 also blocks the same fraction of ions as are incident on foil 40 so that the count rates C1 and C2 can be directly compared to derive the fluxes of light and heavy ions.

The ratio $R_j$ of count rates measured by both detectors 70 and 80, respectively, for a particular ion species j (e.g., j equals $H^+$ or $O^+$) is $$R_j = \frac{C_1}{C_2} = \frac{\varepsilon_1}{\varepsilon_2} T_F. \tag{3}$$

The ratio $R_j$, which depends on the energy and species of incident ions 10 and the thickness and composition of foil 40, is related to the probability $T_F$ that an ion is transmitted through foil 40 by the ratio of the energy-dependent detection efficiencies $\epsilon_1$ and $\epsilon_2$.

When using the present invention to measure combined fluxes of $H^+$ and $O^+$, as would be the case for measuring the plasma environment of a spacecraft, the mean count rates in first detector 70, i.e., $C_1=C_1(H^+)+C_1(O^+)$, and second detector 80, $C_2=C_2(H^+)+C_2(O^+)$, are measured. Thus, using Eqs. 1–3, the absolute $H^+$ and $O^+$ fluxes at the exit of the ESA 20 are:

$$\phi_{H+} = \frac{1}{AT_G\varepsilon_{2,H+}} \frac{C_1 - R_{0+}C_2}{R_{H+} - R_{0+}} \tag{4}$$

$$\phi_{O+} = \frac{1}{AT_G\varepsilon_{2,O+}} \frac{R_{H+}C_2 - C_1}{R_{H+} - R_{0+}} \tag{5}$$

The absolute $H^+$ and $O^+$ fluxes incident on the instrument are derived using Equations 4 and 5 combined with the energy response, angular response, and entrance aperture area of the electrostatic energy analyzer. The detection efficiencies $\epsilon_{2,H+}$ and $\epsilon_{2,O+}$ and count ratios $R_{H+}$ and $R_{O+}$ can be determined by laboratory calibration.

Of particular interest is measuring the abundance of $O^+$ relative to $H^+$, which is simply the ratio of Equations 4 and 5:

$$\frac{\phi_{O+}}{\phi_{H+}} = \frac{\varepsilon_{2,H+}}{\varepsilon_{2,O+}} \frac{R_{H+}C_2 - C_1}{C_1 - R_{0+}C_2} \tag{6}$$

While the measurement accuracy of the relative fluxes $\phi_{O+}/\phi_{H+}$ depends on the total accumulated counts in detectors 70 and 80 during the time interval of the measurement, the accuracy is maximized when the thickness of foil 40 results in a transmission of $H^+$ that is much greater than that of $O^+$, for example when $R_{H+}>0.75$ and $R_{O+}<0.25$.

Figure 1C:
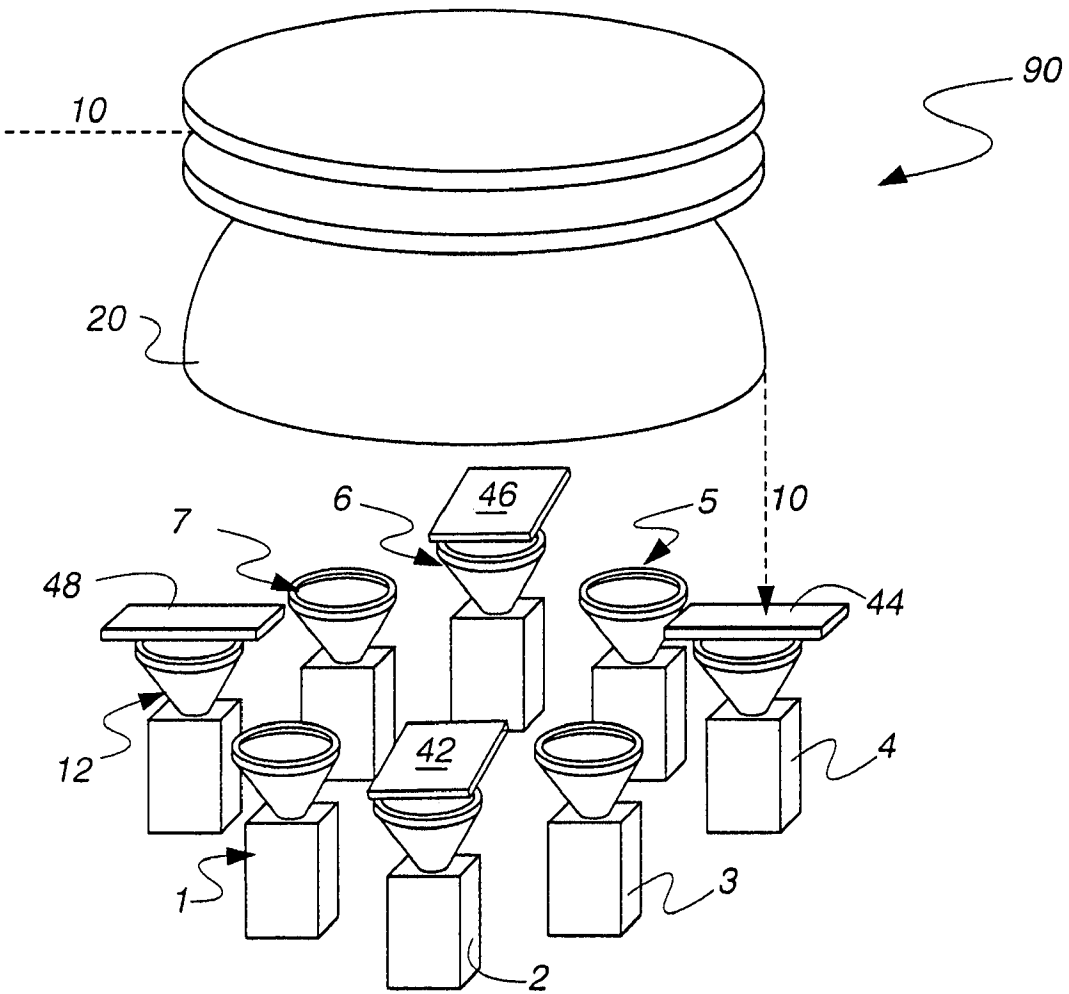
FIG. 1*c* shows a schematic of another embodiment of the present invention where a top-hat electrostatic energy analyzer is shown with a circular array of channel electron multiplier detector elements located at the exit of the energy-per-charge analyzer that are alternately covered with a foil or are foil-less.

Referring to FIG. 1*c*, typical ion energy-per-charge (E/q) spectrometer 90 consists of ESA 20 in a "top hat" configuration or a spherical section geometry. ESA 20 is normally followed by an array of detectors alternately with a foil (detector elements consisting of combined first detector 70 and foil 40 in FIG. 1*a* are noted as even-numbered elements 2, 4, 6, and 8 with corresponding foils 42, 44, 46, and 48 in FIG. 1*c*) and without a foil (detector elements consisting of second detector 80 in FIG. 1*a* are noted as odd-numbered elements 1, 3, 5, and 7 in FIG. 1*c*) is located at the circular exit of ESA 20. Each detector element views a different azimuthal angle, providing angle-resolved measurements over a wide (360°) azimuthal field-of-view (FOV). An advantage of top hat ESA 20 is that ion 10 throughput from the entrance of ESA 20 to the exit of ESA 20 is the same for all detector elements 1, 2, 3, 4, 5, 6, 7 and 8.

The ion fluxes in space plasmas can be anisotropic, having a cylindrical symmetry about the local magnetic field direction. An asymmetric ion distribution results in an ion flux 10 incident on ESA 20 that is a smoothly-varying function of the azimuthal angle and of the orientation of the circular entrance aperture of ESA 20 relative to the direction of the magnetic field. To compensate for the difference in the incident ion flux on the detector elements 1, 2, 3, 4, 5, 6, 7 and 8, a simple derivation of the fluxes $\phi_{H+}$ and $\phi_{O+}$ in Equations 4 and 5 at one azimuthal angle uses the counts measured by the detector element located at that azimuthal angle counts and the average of the counts measured by the two adjacent detector elements. For example, the fluxes $\phi_{H+}$ and $\phi_{O+}$ in Equations 4 and 5 at detector 2 in FIG. 1*c* are derived using the measured count rate $C_1$ in detector 2 and the count rate $C_2$, which equals the average of the measured count rate in detector 1 and the measured count rate in detector 3.

In another example, the fluxes $\phi_{H+}$ and $\phi_{O+}$ in Equations 4 and 5 at detector 3 in FIG. 1*c* are derived using the measured count rate $C_2$ in detector 3 and count rate $C_1$, which is the average of the measured counts rate in detector 2 and the measured count rate in detector 4. When the spacecraft spin axis is parallel to the plane of the field-of-view of the ESA, the full 4π steradian distribution of ions, including a directional anisotropy if present, can be measured in one-half spacecraft spin.

A more complex analysis of the $H^+$ and $O^+$ fluxes can be performed by fitting a smoothly-varying count rate function $C_1(\theta)$ that depends on incident azimuthal angle θ of ions 10 using the measured count rates in detector elements 2, 4, 6, and 8 having a foil and another smoothly varying function $C_2(\theta)$ that depends on incident azimuthal angle 0 using the measured count rates in detector elements 1, 3, 5, and 7. The azimuthal-dependent fluxes $\phi_{H+}(\theta)$ and $\phi_{O+}(\theta)$ are then derived using $C_1(\theta)$ for $C_1$ in Equations 4 and 5 and using $C_2(\theta)$ for $C_2$ in Equations 4 and 5.

Therefore, the count rates in the array of alternating detectors 1, 3, 5, and 7 having no foils and the count rates in the array of alternating detectors 2, 4, 6, and 8 having foils can be used to monitor and interpolate anisotropies in the incident ion fluxes that might falsely appear as a variation in $O^+$ abundance relative to $H^+$ if the relative count rate between a single pair of adjacent foil and foil-less channels is compared.

Figure 1D:
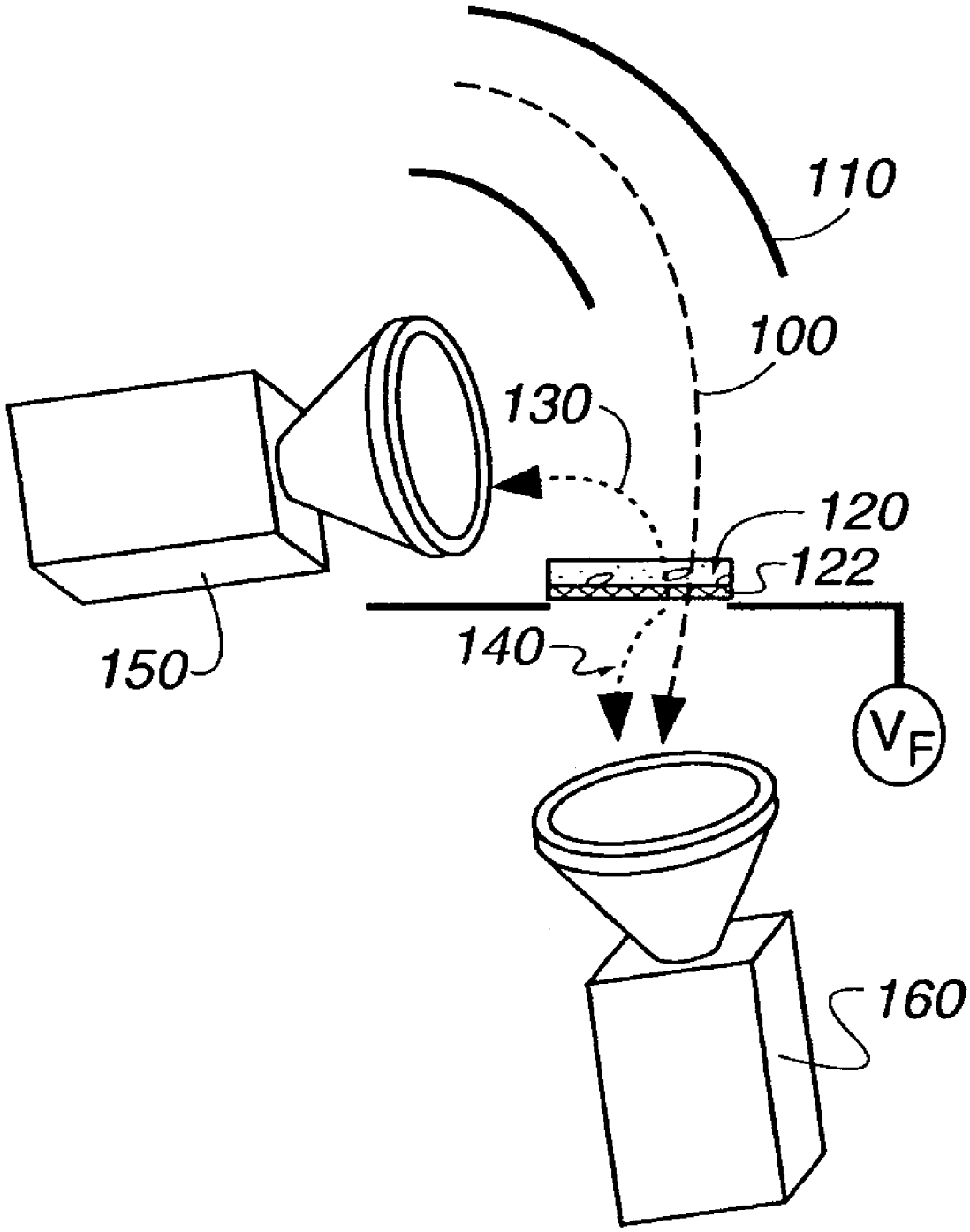
FIG. 1*d* shows a schematic of another embodiment of the present invention where an electrostatic energy analyzer is followed by a single foil and a detector.

Another embodiment of the present invention shown in FIG. 1*d* utilizes electrostatic energy analyzer 110 to select an energy passband of incident ions 100. Ions 100, falling within this energy passband and transiting the electrostatic energy analyzer, subsequently are incident on foil 120 of sufficient thickness so that most or all $H^+$ atoms of the selected energy transit foil 120, but most or all $O^+$ of the selected energy are stopped in foil 120. Note that support grid 122 may be used as structural support to foil 120.

First electron multiplier detector 160 detects ions 100 that transit foil 120. First electron multiplier detector 160 can be placed to measure the ions that transit foil 120, secondary electrons 140 emitted from the rear of foil 120 that indicate that an ion has transited the foil, or both the ions that transit foil 120 and secondary electrons 140 emitted from the back of foil 120.

Ions 100 incident on foil 120 generate secondary electrons 130 at the entrance surface of foil 120. Secondary electrons 130 are detected by second electron multiplier detector 150 placed in a location to detect secondary electrons emitted off of the front of foil 120. Detection by second detector 150 indicates that an ion is incident on foil 120. Comparison of the counts measured in first detector 160 and counts measured in second detector 150 allow determination of the incident $H^+$ flux and the incident $O^+$ flux.

In practice, the count rates in detectors 160 and 150 resulting from $H^+$ and $O^+$ are a function of factors including the detection probabilities of $H^+$ and $O^+$, the yields by $H^+$ and $O^+$of secondary electrons 130 and 140 from the front and rear surfaces of foil 120, the detection efficiencies of secondary electrons 130 and 140, the transmission probability of $H^+$ and $O^+$ through foil 120 at the selected energy of the electrostatic energy analyzer 110, and the transmission of support grid 122, if used, for structural support of foil 120.

At energies for which $O^+$ cannot transit the foil, a coincidence of detected events between first detector 160 and second detector 150 indicates that the incident ion was $H^+$. This coincidence measurement can be important for separating $H^+$ from background counts at times in which penetrating radiation, for example during a geomagnetic storm or when the spacecraft is in the terrestrial radiation belts, stimulates detectors 150 and 160.

For the embodiment in FIG. 1*d*, the count rate of first detector 160 located behind foil 120 follows from, and is identical to, that of first detector 70 in the embodiment shown in FIG. 1*a:*

$$C_1=A\phi T_G\epsilon_1 T_F \tag{7}$$

The count rate $C_3$ resulting from ions impacting foil 120, generation of secondary electrons 130 at the front surface of foil 120, and detecting secondary electrons 130 in second detector 150 is $$C_3=A\phi\epsilon_3 \tag{8}$$

where $\epsilon_3$ is the combination of the probability that an incident ion generates secondary electrons 130 at the front surface of foil 120 and the probability that secondary electrons 130 register a pulse in second detector 150. The area (A) and incident flux ($\phi$) of the ion beam incident on foil 120 for each ion species are identical to those described in Equation 7.

From Equations 7 and 8 the ratio $R_j$ of count rates of detectors 160 and 150 for a particular ion species j at incident energy $E_0$ is $$R_j = \frac{C_1}{C_3} = \frac{\varepsilon_1}{\varepsilon_3} T_G T_F. \tag{9}$$

The value of $R_j$ for $H^+$ and $O^+$ as a function of incident energy can be derived in the laboratory by directing an ion beam of $H^+$ or $O^+$ of known energy onto the apparatus and recording the count rates $C_1$ and $C_3$.

When using the apparatus to measure combined fluxes of $H^+$ and $O^+$ as would be the case for measuring the plasma environment of a spacecraft, the mean count rates in first detector 160, i.e., $C_1=C_1(H^+)+C_1(O^+)$, and second detector 150, $C_3=C_3(H^+)+C_3(O^+)$, are measured. Using Equations 7–9, the absolute $H^+$ and $O^+$ fluxes at the exit of the ESA 110 are:

$$\phi_{H+} = \frac{1}{A\varepsilon_{3,H+}} \frac{C_1 - R_{0+}C_3}{R_{H+} - R_{0+}} \tag{10}$$

$$\phi_{O+} = \frac{1}{A\varepsilon_{3,O+}} \frac{R_{H+}C_3 - C_1}{R_{H+} - R_{0+}} \tag{11}$$

At energies for which no or few $O^+$ are detected (i.e., $R_{O+}\approx 0$) so that only or mostly $H^+$ is detected, coincidence measurements between detectors 150 and 160 enable derivation of the absolute detection efficiency $\epsilon_3$[H. O. Funsten, R. W. Harper, and D. J. McComas, Absolute Detection Efficiency of Space-Based Ion Mass Spectrometers and Neutral Atom Imagers, *Review of Scientific Instruments,* 76 (2005)053301.]. The probability of a coincidence between detectors 150 and 160 is simply the product of their detection efficiencies, so the coincidence count rate is $$C_{1+3}=A\phi T_G\epsilon_1 T_F\epsilon_3 \tag{12}$$

The ratio $C_{1+3}/C_1$ of coincident counts to counts in first detector 160 yields $$\frac{C_{1+3}}{C_1} = \varepsilon_3 \tag{13}$$

Therefore, the absolute detection efficiency $\epsilon_3$ of second detector 150 for incident $H^+$ can be measured while the instrument is in space without absolute knowledge of the incident $H^+$ flux. Once $\epsilon_3$ is measured, the absolute incident $H^+$ flux can be determined using Equation 10.

By combining Equations 10 and 11, the abundance of $O^+$ relative to the abundance of $H^+$ is:

$$\frac{\phi_{O+}}{\phi_{H+}} = \frac{\varepsilon_{3,H+}}{\varepsilon_{3,O+}} \frac{R_{H+}C_3 - C_1}{C_1 - R_{0+}C_3}. \tag{14}$$

The statistical error associated with the ratio $\phi_{O+}/\phi_{H+}$ is minimized when the value $R_{H+}$ approaches 1 and the value $R_{O+}$ approaches 0. While the measurement accuracy of the relative fluxes of $H^+$ and $O^+$ depends on the total accumulated counts in detectors 150 and 160, the accuracy is maximized when the thickness of foil 120 results in a transmission of $H^+$ that is much greater than that of $O^+$, for example when $R_{H+}>0.75$ and $R_{O+}<0.25$.

Transmission of $O^+$ and $H^+$ Through Thin Foils

Thin foils can be fabricated of any material, although the preferred embodiment is carbon as the foil material because it is easily fabricated, the thickness can be controlled with reasonable accuracy (typically ±0.5 μg $cm^{-2}$ as cited by the manufacturer ACF Metals, Inc.), and it has been successfully used on more than 45 space-based instruments [D. J. McComas, F. Allegrini, C. J. Pollock, H. O. Funsten, S. Ritzau, G. Gloeckler, Ultra-thin (~10 nm) Carbon Foils in Space Instrumentation, Rev. Sci. Instrum., 75 (2004)

Figure 2:
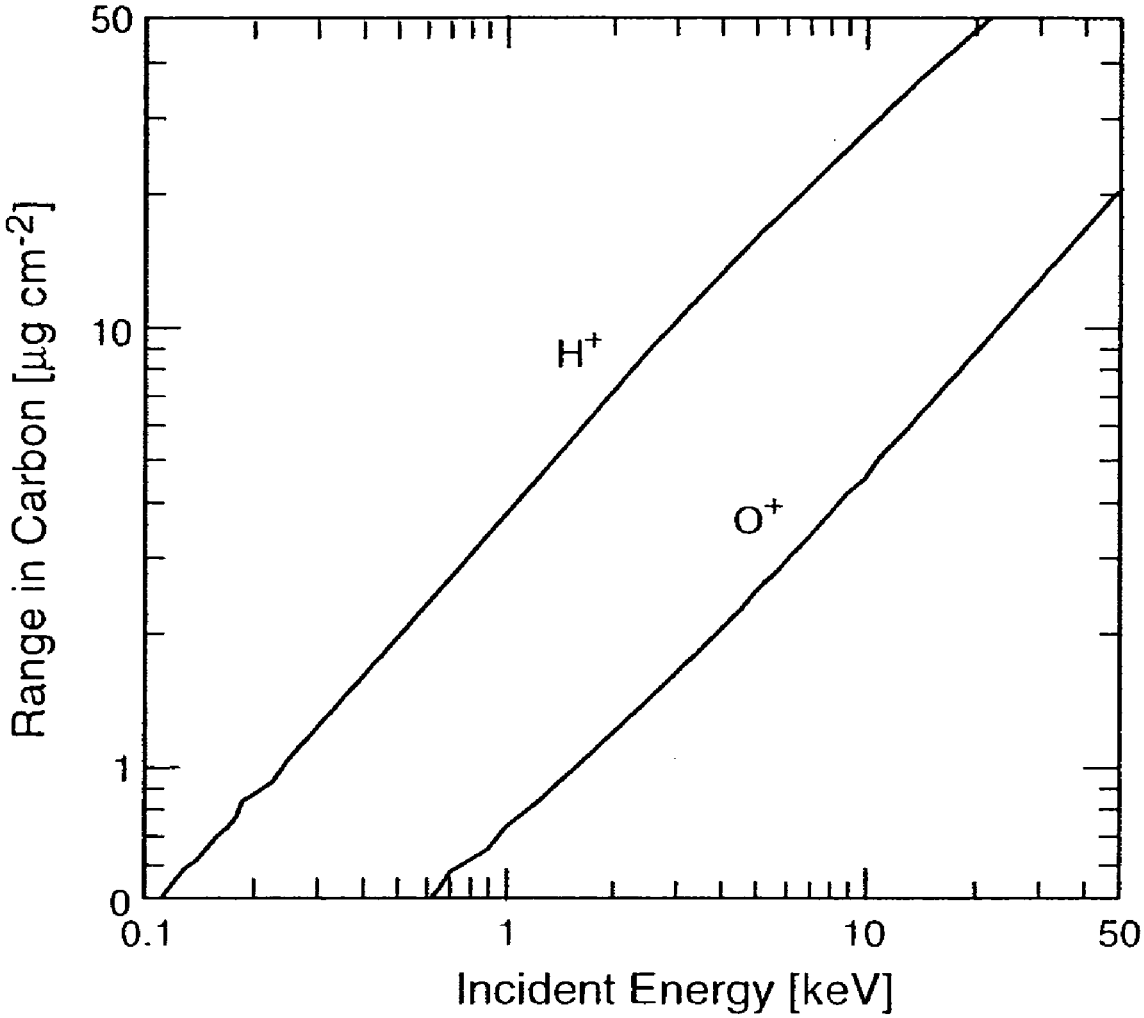
FIG. 2 graphically shows the range of $H^+$ and $O^+$ in carbon and is shown as a function of incident ion energy $E_0$.

4863–4870]. Often, it is preferred that the foil be affixed to a support grid to maintain structural integrity of the foil. FIG. 2 shows the mean projected range of $H^+$ and $O^+$ incident on a carbon target derived using the Stopping and Range of Ions in Matter code [J. F. Ziegler, J. P. Biersack, and U. Littmark, Stopping and Range of Ions in Solids, Pergamon, New York, 1985, Vol. 1.]. The range of $H^+$ is approximately 3.5 times the range of $O^+$, which results in a wide energy range over which $H^+$ will transit a foil and $O^+$ will not transit the foil. An optimal foil thickness for mass discrimination between $H^+$ and $O^+$ is selected based on the energy range whose measurement will yield key information for assessing the activity level of the magnetosphere or the potential damage to spacecraft materials due to $O^+$ and $H^+$.

Measurement Methodology

To demonstrate the invention shown in FIG. 1*a* and described in Eqs. 1–6, carbon foils of thicknesses 6 and 12 μg $cm^{-2}$ were procured from ACF Metals, Inc. The foils were subsequently mounted on a 333 line-per-inch (lpi) electroformed grid that was affixed to an aperture frame having a 5.9-mm-diameter aperture. The grid transmission $\tau_G$ was measured to be 83%.

A 2.7-mm-diameter, magnetically mass-resolved beam of $H^+$ or $O^+$ ions of known energy $E_0$ and constant flux $\phi$ was first directed toward an aperture frame with a grid only and no foil. Then the output count rate $C_2$ of a microchannel plate (MCP) detector, due to detection of ions that passed through the foil-less grid, was recorded. Then, the foil-less, gridded aperture was replaced by an aperture frame with a foil on a support grid, and the detector count rate $C_1$ due to ions transmitted through the foil and support grid was recorded with the same MCP detector.

Both the foil-less gridded aperture frame and the aperture frame with grid and foil were located 6.5 mm from the MCP detector and were biased to −100 V relative to the front surface of the MCP detector. This bias maximized the detection efficiency of ions for two reasons. First, secondary electrons created by ions that struck the web region of the front MCP were electrostatically suppressed back toward the MCP, and could thus initiate an electron avalanche in the MCP so that the ion is detected. Second, secondary electrons generated at the exit surface of the foil by ions that transit the foil were accelerated toward the MCP and could also initiate an avalanche, thereby increasing the ion detection efficiency when ions transited the foil.

Foil Transmission Measurement Results

Figure 3:
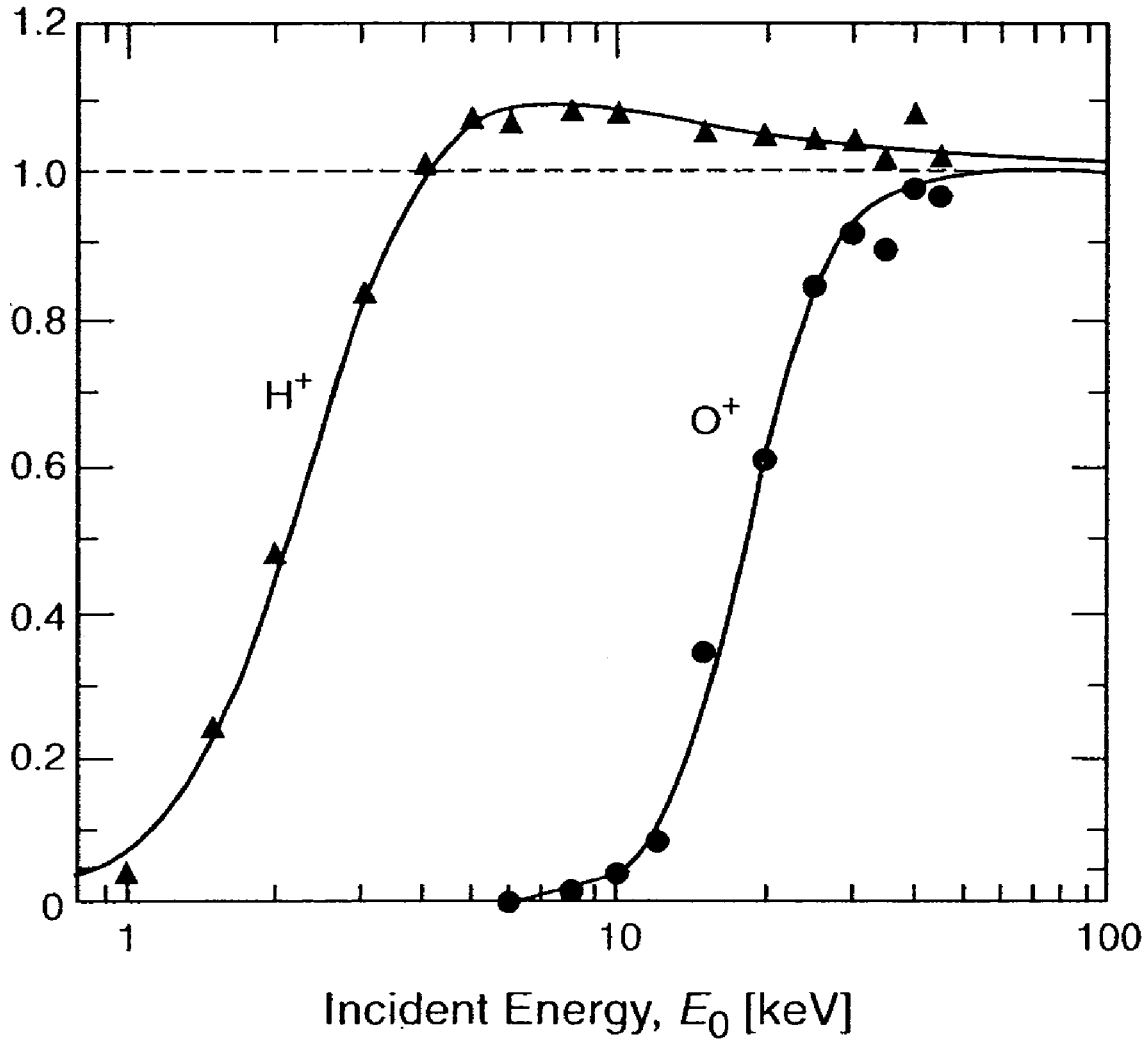
FIG. 3 graphically shows the measured ratio of counts (Equation 3) for beams of $O^+$ and $H^+$ incident on a 6 μg $cm^{-2}$ carbon foil as a function of the incident ion energy. The solid lines are analytic fits to the data.
Figure 4:
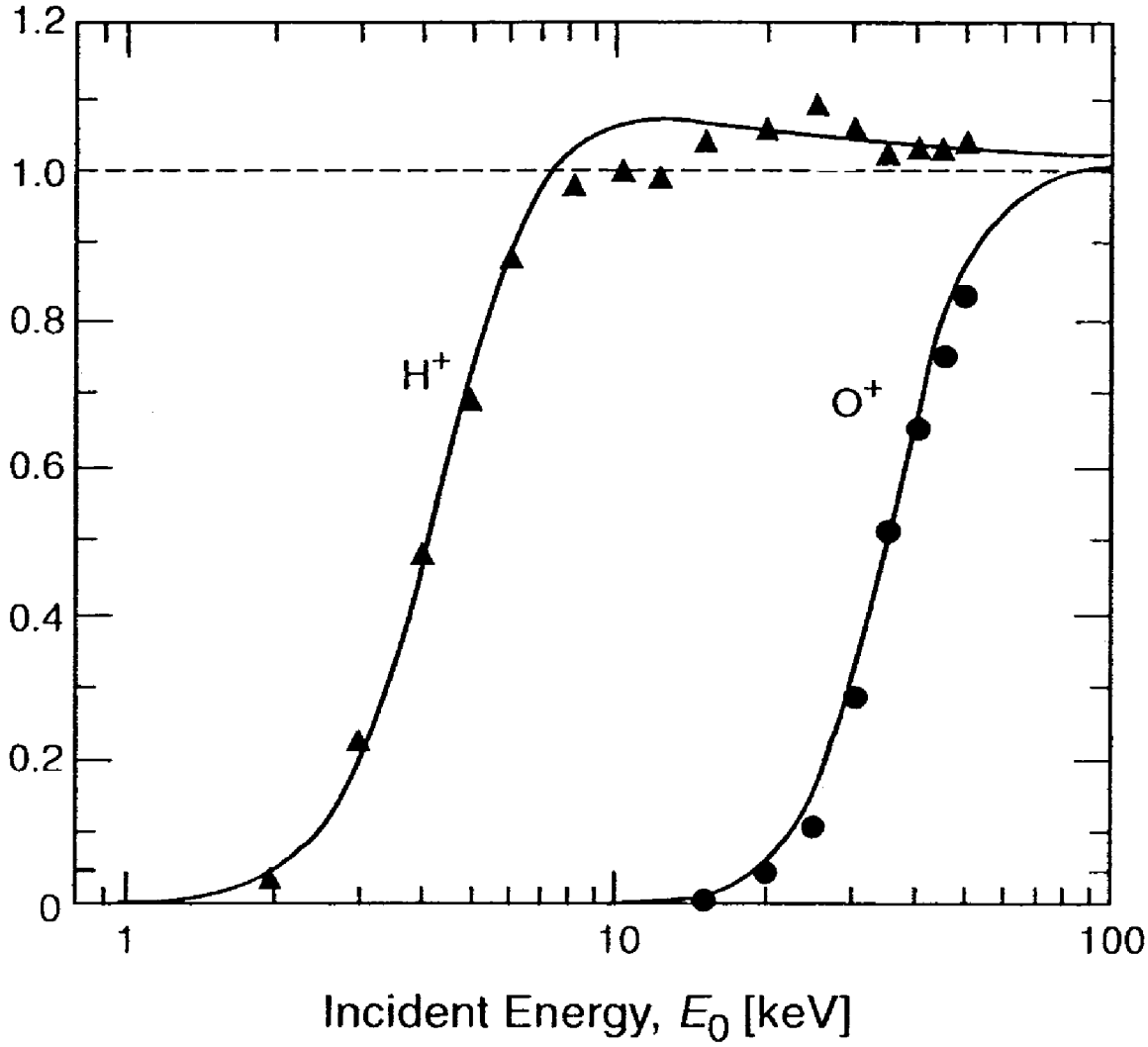
FIG. 4 graphically shows the measured ratio of counts (Equation 3) for beams of $O^+$ and $H^+$ incident on a 12 μg $cm^{-2}$ carbon foil as a function of the incident ion energy. The solid lines are analytic fits to the data.

FIG. 3 shows the measured ratios $R_{H+}$ and $R_{O+}$ as a function of incident ion energy $E_0$ as defined by Equation 3 for a carbon foil of thickness 6 μg $cm^{-2}$, and FIG. 4 shows the same ratios ($R_{H+}$ and $R_{O+}$) for a carbon foil of thickness 12 μg $cm^{-2}$. Qualitatively, several expected features are apparent for a particular combination of ion species and foil thickness. First, no ions are observed to transit a foil and be detected at low energies (e.g., in FIG. 4 below 1 keV for $H^+$ and below 10 keV for $O^+$) because they lose all or most of their energy in the foil and are not detected. Second, the energy at which ions begin to transit a foil and be detected is higher for a thicker foil. Third, $O^+$ begins to transit a foil of a particular thickness at an energy that is substantially higher than for $H^+$ due to the large energy loss of $O^+$ in the foil relative to $H^+$. Fourth, at higher energies the ratio R increases toward a maximum of $R \approx 1$ as more ions successfully transit a foil and are detected (although $R_{H+}$ for $H^+$ reaches a value slightly higher than unity and subsequently decreases toward $R_{H+}=1$).

The presence of an overshoot for $H^+$ in which $R_{H+}>1$ is associated with the detection efficiencies $\epsilon_1$ and $\epsilon_2$. While $\epsilon_2$ describes the detection efficiency of ions transiting the foil-less aperture and striking the detector, $\epsilon_1$ includes the combined detection efficiencies of both an incident ion that transits the foil and the secondary electrons emitted from the foil's rear surface by the ion, yielding $\epsilon_2>\epsilon_1$ for energies at which most $H^+$ transits the foil (i.e., $T_F \approx 1$). Therefore, when $\epsilon_2>\epsilon_1$ and $T_F \approx 1$, Equation 6 yields $R_{H+}>1$. This is the case for $E_0>4$ keV in FIG. 3 and $E_0>10.5$ keV in FIG. 4.

In FIGS. 1*a*, 1*b*, and 1*d*, a negative bias can be applied to the foil to accelerate low energy $H^+$ to an energy that is sufficient for its transmission through the foil and subsequent detection by the MCP detector. The magnitude of the applied bias is selected based on the minimum energy $H^+$ needed for detection to characterize the ambient space environment. For example, in FIG. 3*a* foil bias of −3 kV yields a ratio $R_{H+}>90\%$ of $H^+$ at an incident energy of 1 eV for a 6 μg $cm^{-2}$ carbon foil, resulting in the detection of 1 eV $H^+$. As another example, in FIG. 4*a* foil bias of −6 kV yields a ratio $R_{H+}>80\%$ of $H^+$ at an incident energy of 1 eV for a 12 μg $cm^{-2}$ carbon foil, resulting in the detection of 1 eV $H^+$. Furthermore, a single power supply can be used to bias both the foil and the front of the MCP detector so that the detector anode, from which the signal is extracted, is referenced to ground potential. An advantage of this configuration is that a high voltage coupling capacitor is not needed to extract the signal from the detector.

The energy range over which the present invention produces accurate measurements of the relative abundances of $H^+$ and $O^+$ depends on several factors. First, increasing the total counts accumulated in each detector over the period of measurement maximizes the measurement accuracy. Increasing the time over which measurements are accumulated and increasing the aperture area A both increase the total accumulated counts. Second, the abundance ratio is maximized by maximizing $R_{H+}$ and minimizing $R_{O+}$. For example, an accurate determination of $\phi_{H+}$ and $\phi_{O+}$ results when, for example, $R_{H+} \geqq 0.75$ and $R_{O+} \leqq 0.25$. For the 6 μg $cm^{-2}$ carbon foil whose data is shown in FIG. 3, this results in an energy range of approximately 2.5 keV to 13 keV. For the 12 μg $cm^{-2}$ carbon foil whose data is shown in FIG. 4, this results in an energy range of approximately 5 keV to 28 keV.

The foregoing description of the invention has been presented for purposes of illustration and description and is not intended to be exhaustive or to limit the invention to the precise form disclosed, and obviously many modifications and variations are possible in light of the above teaching.

The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A detector element for mass spectrometry of a flux of heavy and light ions, comprising:

a. a first foil capable of transit by light ions from said flux of heavy and light ions, b. a first detector, operatively placed to detect said light ions that transit said first foil, and c. a second detector operatively placed to detect said flux of heavy and light ions.

2. The detector element described in claim 1 further comprising an electrostatic energy analyzer that receives said flux of heavy and light ions in a broad energy range allowing transmission of most or all said light ions.

3. The detector element described in claim 1 further comprising a support grid to provide structural support for said first foil.

4. The detector element described in claim 1 where a conductive grid is applied over an aperture in front of said second detector to provide a uniform and planar electric field to ensure consistent first detector response.

5. The detector element described in claim 1 further including a second foil that is affixed in front of said second detector where said flux of heavy and light ions create secondary electrons within said second foil to increase the detection efficiency of said second detector.

6. The detector element described in claim 1 where said first detector and second detector are electron multiplier detectors.

7. The detector element described in claim 1 further comprising an array of two or more detector elements.

8. A detector element for mass spectrometry of a flux of heavy and light ions, comprising:

a. a foil, comprising a front side and a back side, sized to allow light ions from a flux of heavy and light ions incident on said front side to transit through said foil while preventing transmission of heavy ions through said foil, b. a first detector that is operatively placed to receive and detect ions that transit said foil and secondary electrons that are generated by ions that transit said foil, c. a second detector that is operatively placed to receive and detect secondary electrons emitting from said front side of said foil to provide a signal relative to said flux of light ions and heavy ions incident on said front side of said foil.

9. The detector element described in claim 8 further comprising an electrostatic energy analyzer that receives ions in a broad energy range and allows transmission to said front side of said foil of ions having energies within a range of energies such that light ions can transit said foil and be detected and heavy ions cannot transit said foil and be detected.

10. The detector element described in claim 8 further comprising a support grid to provide structural support for said foil.

11. A method of mass spectrometry, comprising:

a. subjecting a first foil, comprising a front side and a back side, to a flux of heavy and light ions on said front side, b. subjecting a first detector to light ions that transit said first foil, and to secondary electrons created by said light ions within said first foil, to produce a first count rate, c. subjecting a second detector to said flux of heavy and light ions to produce a second count rate of detected heavy ions and light ions d. comparing said first count rate to said second count rate, and e. determining a ratio of transmitted light ions to said flux of heavy and light ions.

12. The method of claim 11, further comprising biasing said first foil to accelerate light ions to an energy range where said light ions can transit said first foil, thereby increasing the detection efficiency of said light ions.

13. The method of claim 11, further comprising applying a negative bias to said front of said first foil relative to said first detector to accelerate secondary electrons from said first foil to said first detector thereby increasing the detection efficiency of said light ions.

14. The method of claim 11, further comprising placing a second foil in front of said second detector where secondary electrons created by said ions within said second foil increase the detection efficiency of said second detector.

15. A method of mass spectrometry, comprising:

a. subjecting a foil, comprising a front side and a back side, to a flux of ions on said front side, b. producing a first count rate by subjecting a first detector to ions that transit said foil, c. producing a second count rate by subjecting a second detector to secondary electrons created when said flux of ions enters said foil, d. comparing said first count rate to said second count rate, and e. determining a ratio of transmitted ions to said secondary electrons.

16. The method of claim 15, further comprising biasing said foil to accelerate light ions to an energy range where said light ions can transit said foil, thereby increasing the detection efficiency of said light ions.

17. The method of claim 15, further comprising applying a negative bias to said foil relative to said first detector to accelerate secondary electrons from said back side of said foil to said first detector, thereby increasing the detection efficiency of said ions that transit said foil.

18. The method of claim 15, further comprising applying a negative bias to said foil relative to said second detector to accelerate secondary electrons from said front side of said foil to said second detector, thereby increasing the detection efficiency of said ions incident on said front of said foil.

* * * * *